US008668257B2

(12) United States Patent
Wu

(10) Patent No.: US 8,668,257 B2
(45) Date of Patent: Mar. 11, 2014

(54) FOLDABLE BRACKET OF A CHAIR

(76) Inventor: Yao-Chuan Wu, Chiayi Hsien (TW)

( * ) Notice: Subject to any disclaimer, the term of this patent is extended or adjusted under 35 U.S.C. 154(b) by 320 days.

(21) Appl. No.: 13/168,337

(22) Filed: Jun. 24, 2011

(65) Prior Publication Data

US 2012/0326472 A1 Dec. 27, 2012

(51) Int. Cl.
*A47B 83/02* (2006.01)

(52) U.S. Cl.
USPC ..... 297/162; 297/161; 297/173; 297/188.21; 403/92; 403/94; 403/103; 403/108; 248/446; 248/454; 248/458; 248/447; 248/462

(58) Field of Classification Search
USPC ..... 297/171, 161, 162, 188.19, 188.21, 297/188.15, 173, 155, 154; 403/92, 108, 403/84, 106, 94, 91, 103, 104; 248/444, 248/446, 447, 454, 458, 462, 463
See application file for complete search history.

(56) References Cited

U.S. PATENT DOCUMENTS

| | | | | | |
|---|---|---|---|---|---|
| 258,354 | A * | 5/1882 | Bell | 248/456 |
| 389,952 | A * | 9/1888 | Byrkit | 248/454 |
| 527,056 | A * | 10/1894 | Gilson | 297/464 |
| 646,835 | A * | 4/1900 | Jackson | 248/447.2 |
| 846,389 | A * | 3/1907 | Blackburn | 403/108 |
| 876,023 | A * | 1/1908 | Schurger | 108/128 |
| 1,231,301 | A * | 6/1917 | Schlanger | 297/161 |
| 1,385,663 | A * | 7/1921 | Brauchli | 248/454 |
| 3,811,151 | A * | 5/1974 | Kuemmerlin | 16/329 |
| 4,056,115 | A * | 11/1977 | Thomas | 135/67 |
| 4,332,499 | A * | 6/1982 | Stucheli | 403/53 |
| 4,645,167 | A * | 2/1987 | Hardwick | 248/520 |
| 4,666,328 | A * | 5/1987 | Ryu | 403/92 |
| 4,687,076 | A * | 8/1987 | Tu | 182/178.2 |
| 4,815,688 | A * | 3/1989 | Wood | 248/230.2 |
| 4,929,113 | A * | 5/1990 | Sheu | 403/157 |
| 5,115,536 | A * | 5/1992 | Jarvis | 15/235.8 |
| 5,123,768 | A * | 6/1992 | Franklin | 403/96 |
| 5,161,766 | A * | 11/1992 | Arima | 248/447 |
| 5,263,507 | A * | 11/1993 | Chuang | 135/140 |
| 5,564,779 | A * | 10/1996 | Tolbert et al. | 297/144 |
| 5,653,499 | A * | 8/1997 | Goodall | 297/170 |
| 5,671,900 | A * | 9/1997 | Cutler | 248/451 |
| 5,674,027 | A * | 10/1997 | Warnaar | 403/404 |
| 5,720,465 | A * | 2/1998 | Peltzer et al. | 248/453 |
| 5,751,548 | A * | 5/1998 | Hall et al. | 361/679.41 |
| 5,765,958 | A * | 6/1998 | Lan | 403/97 |
| 5,865,124 | A * | 2/1999 | Wroe | 108/26 |
| 6,250,599 | B1 * | 6/2001 | Goldberg | 248/444.1 |
| 6,332,621 | B1 * | 12/2001 | Wu | 280/87.041 |
| 6,375,257 | B1 * | 4/2002 | Wooding et al. | 297/162 |
| 6,375,259 | B1 * | 4/2002 | Ma | 297/217.3 |
| 6,467,986 | B2 * | 10/2002 | Feng | 403/93 |
| 6,629,801 | B2 * | 10/2003 | Cheng | 403/101 |

(Continued)

FOREIGN PATENT DOCUMENTS

WO WO 8705478 A1 * 9/1987 ..... A47B 3/14

*Primary Examiner* — David E Allred
(74) *Attorney, Agent, or Firm* — Alan Kamrath; Kamrath IP Lawfirm, P.A.

(57) ABSTRACT

A foldable bracket of a chair contains a positioning rod, a first rotating rod, a connector, a second rotating rod, and a supporting plate. The positioning rod is connected with the chair. The first rotating rod is rotatably coupled with the positioning rod. The connector is joined with the first rotating rod. The second rotating rod is rotatably coupled with the connector, and the supporting plate is connected to the second rotating rod.

18 Claims, 8 Drawing Sheets

(56) References Cited

U.S. PATENT DOCUMENTS

| | | | | |
|---|---|---|---|---|
| 6,802,328 | B2 * | 10/2004 | Lin | 135/96 |
| 7,040,591 | B1 * | 5/2006 | Simon | 248/458 |
| 7,082,882 | B2 * | 8/2006 | Heimbrock | 108/49 |
| 7,134,719 | B2 * | 11/2006 | Moglin et al. | 297/217.3 |
| 7,252,275 | B1 * | 8/2007 | Puckett et al. | 248/316.6 |
| 7,540,464 | B2 * | 6/2009 | Samari | 248/445 |
| 8,272,604 | B2 * | 9/2012 | Foster | 248/124.1 |
| 2003/0141750 | A1 * | 7/2003 | Rossko | 297/188.21 |
| 2005/0189465 | A1 * | 9/2005 | Matsuoka | 248/451 |
| 2006/0096770 | A1 * | 5/2006 | Roberts | 173/217 |
| 2007/0029850 | A1 * | 2/2007 | Weng | 297/161 |
| 2008/0164729 | A1 * | 7/2008 | Cavanaugh | 297/162 |
| 2010/0194156 | A1 * | 8/2010 | Kim | 297/215.15 |
| 2011/0031785 | A1 * | 2/2011 | Steenson | 297/161 |
| 2011/0305502 | A1 * | 12/2011 | Lo | 403/84 |

* cited by examiner

FOLDABLE BRACKET OF A CHAIR

BACKGROUND OF THE INVENTION

1. Field of the Invention

The present invention relates to a foldable bracket of a chair in which a supporting plate is capable of being adjusted toward any desired angle.

2. Description of the Prior Art

A chair is used in reading a book and supporting a note book. As an example, an aero chair includes a conventional supporting plate disposed on a back side of a front chair. A user sitting on a back chair can place the book or the note book on the supporting plate, but an arrangement has to provide the front and back chairs, thus consuming installation cost.

Even though the supporting plate is connected with armrests of the chair, such a conventional supporting plate can not be adjusted towards a desired angle.

The present invention has arisen to mitigate and/or obviate the afore-described disadvantages.

SUMMARY OF THE INVENTION

The primary objective of the present invention is to provide a foldable bracket of a chair in which a supporting plate is capable of being adjusted toward any desired angle based on a user's requirement.

To obtain the above objective, a foldable bracket of a chair provided by the present invention contains a positioning rod, a first rotating rod, a connector, a second rotating rod, and a supporting plate. The positioning rod is connected with the chair. The first rotating rod is rotatably coupled with the positioning rod. The connector is joined with the first rotating rod. The second rotating rod is rotatably coupled with the connector, and the supporting plate is connected to the second rotating rod.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 6:
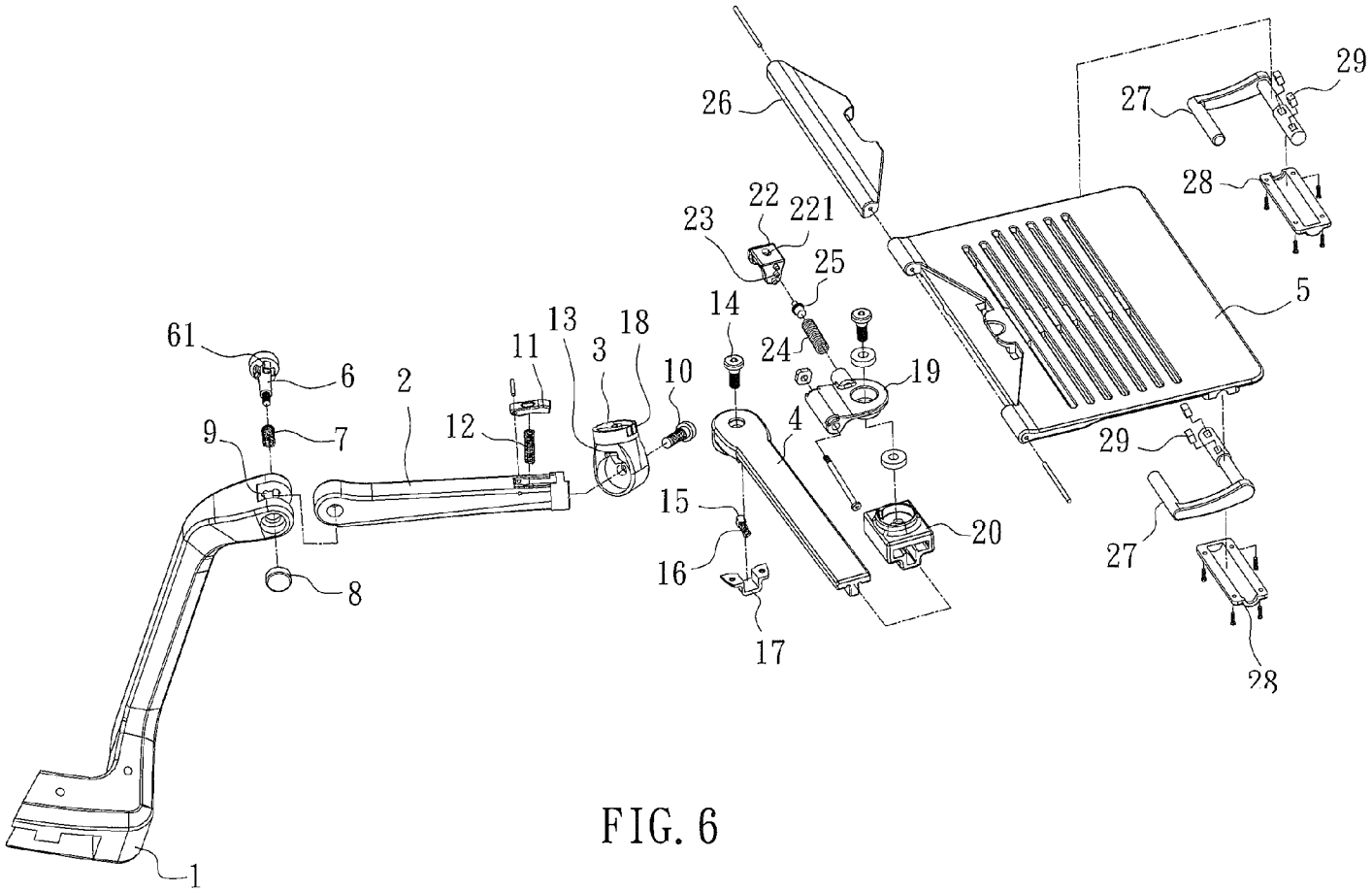
FIG. 6 is a perspective view showing the exploded components of the foldable bracket of the chair according to the present invention.
Figure 7:
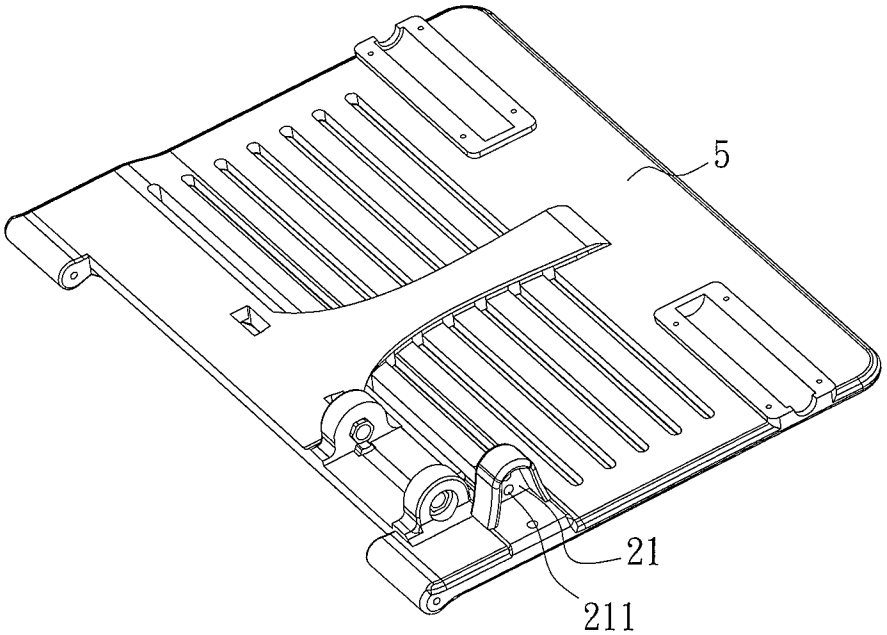
FIG. 7 is a perspective view showing the assembly of a limiting disc of the foldable bracket of the chair according to the present invention.

With reference to FIGS. 6 and 7, a foldable bracket of a chair according to a first embodiment of the present invention comprises a positioning rod 1, a first rotating rod 2, a connector 3, a second rotating rod 4, and a supporting plate 5. The positioning rod 1 is connected with the chair. The first rotating rod 2 is rotatably coupled with the positioning rod 1. The connector 3 is joined with the first rotating rod 2. The second rotating rod 4 is rotatably coupled with the connector 3, and a sliding block 20 beneath the supporting plate 5 is fitted on the second rotating rod 4.

The positioning rod 1 is connected with a leg of the chair by using a first screw. A first connecting structure of the first rotating rod 2 and the positioning rod 1 comprise a first connecting element 6 with four retaining bosses 61, a first spring 7, and a button 8. The first spring 7 is fitted on the first connecting element 6, and the button 8 is fixed on one end of the first connecting element 6. The retaining bosses 61 are retained in a first hole 9 of the positioning rod 1.

A second connecting structure of the connector 3 and the first rotating rod 2 comprise a second connecting element 10, a locking projection 11, and a second spring 12. The locking projection 11 presses the second spring 12, and the locking projection 11 is retained in a second hole 13 of the connector 3.

Figure 8:
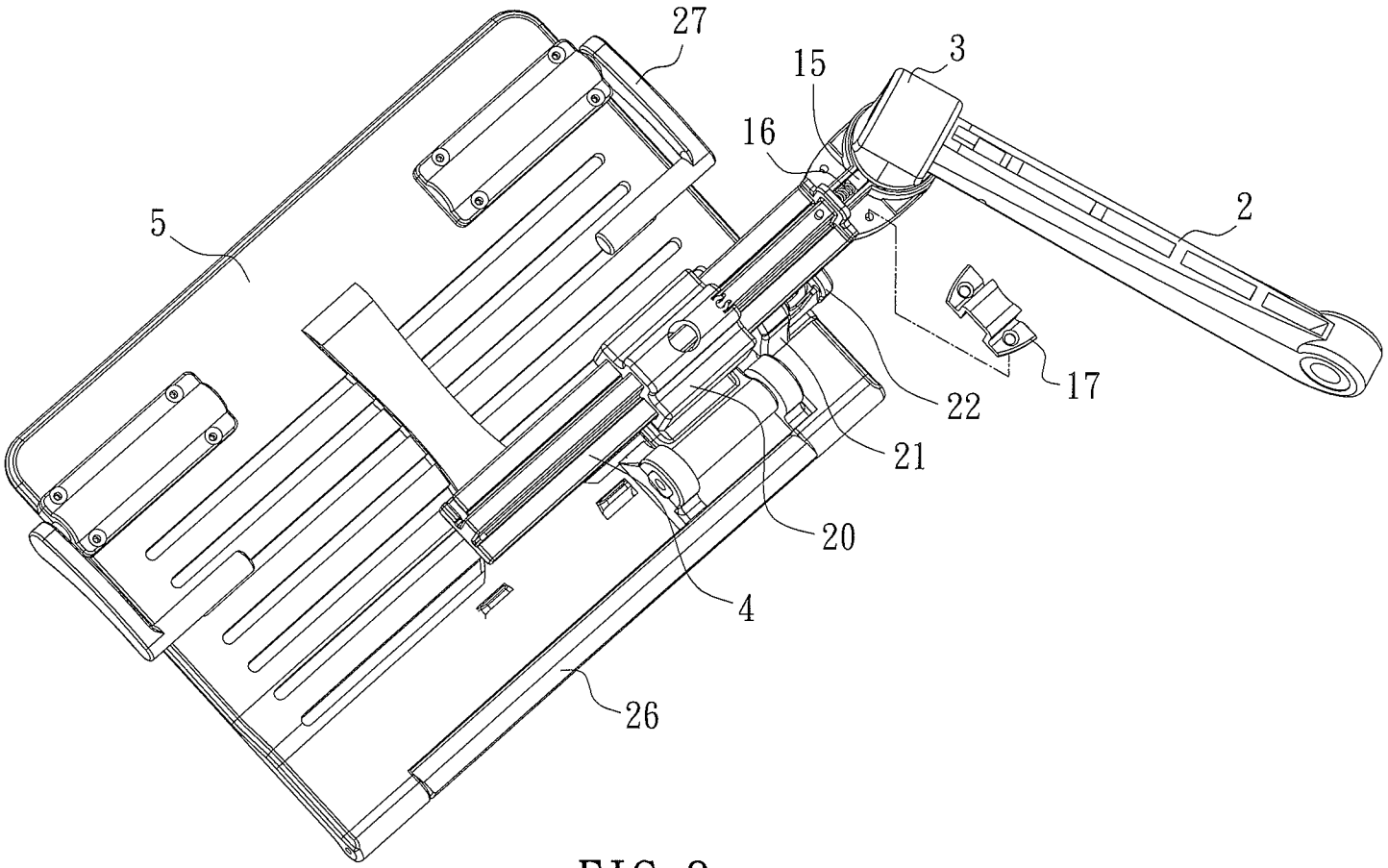
FIG. 8 is a perspective view showing the exploded components of the foldable bracket of the chair according to the present invention.

A third connecting structure of the second rotating rod 4 and the connector 3 comprise a third connecting element 14, a protrusion 15, a third spring 16, and a lid 17 (as illustrated in FIG. 8). The lid 17 covers the protrusion 15 and the third spring 16, and the third spring 16 pushes against the protrusion 15. The protrusion 15 abuts against a toothed portion 18 of the connector 3.

The supporting plate 5 is axially coupled with a holder 19, and the holder 19 is connected with the sliding block 20 by way of a second screw.

The supporting plate 5 is joined with a fixing seat 21 with three apertures 211, and the fixing seat 21 includes a movable pedestal 22 with three tabs 23 fixed therein. The pedestal 22 includes an elongated orifice 221 screwed with the fixing seat 21 by a third screw, and the elongated orifice 221 is used as a slide rail. The holder 19 includes a fourth spring 24 and an inserting peg 25. The fourth spring 24 pushes against the inserting peg 25, and the inserting peg 25 is inserted in one of the three apertures 211 of the fixing seat 21 to be positioned. After pushing against the pedestal 22, the inserting peg 25 is pushed outward to release an engagement. Thereby, the supporting plate 5 is capable of being turned at three levels of rotating angles to satisfy different requirements in reading and using a computer.

Two sides of one end of the supporting plate 5 are axially coupled with a stopping member 26, and the stopping member 26 is applied to stop a book or a note book from sliding downward. Two lower ends of two sides of the supporting plate 5 are axially joined with two pressing members 27 respectively, and each pressing member 27 is covered by a cover 28. The pressing member 27 includes a rubber boss 29 secured therein and is severed to press pages of a book or stop the note book.

A difference of a foldable bracket of a chair according to a second embodiment of the present invention from that of the first embodiment comprises a supporting plate 5 fixed on a second rotating rod 4, and a sliding block 20 of the first embodiment is replaced by a positioning block formed in any shape based on a requirement. A connecting method of the positioning block includes sticking, thread connecting, screw connecting, rivet jointing, or welding.

A difference of a foldable bracket of a chair according to a third embodiment of the present invention from that of the first embodiment comprises a second rotating rod 4 including a sliding slot to insert a sliding block 20.

It is to be noted that any equivalent replacing method to embody the present invention is included in the present invention.

FIGS. 1-5 show the operation of the foldable bracket of the chair.

Figure 1:
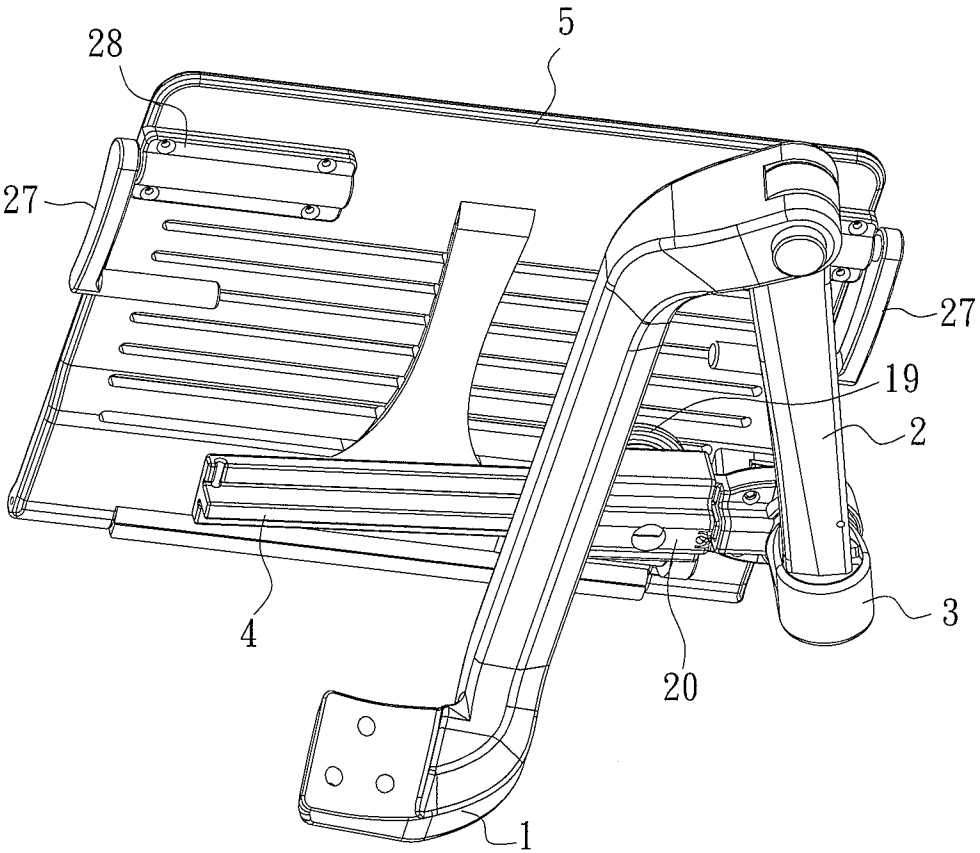
FIG. 1 is a perspective view showing a foldable bracket of a chair according to the present invention folded.

FIG. 1 shows the foldable bracket stored.

Figure 2:
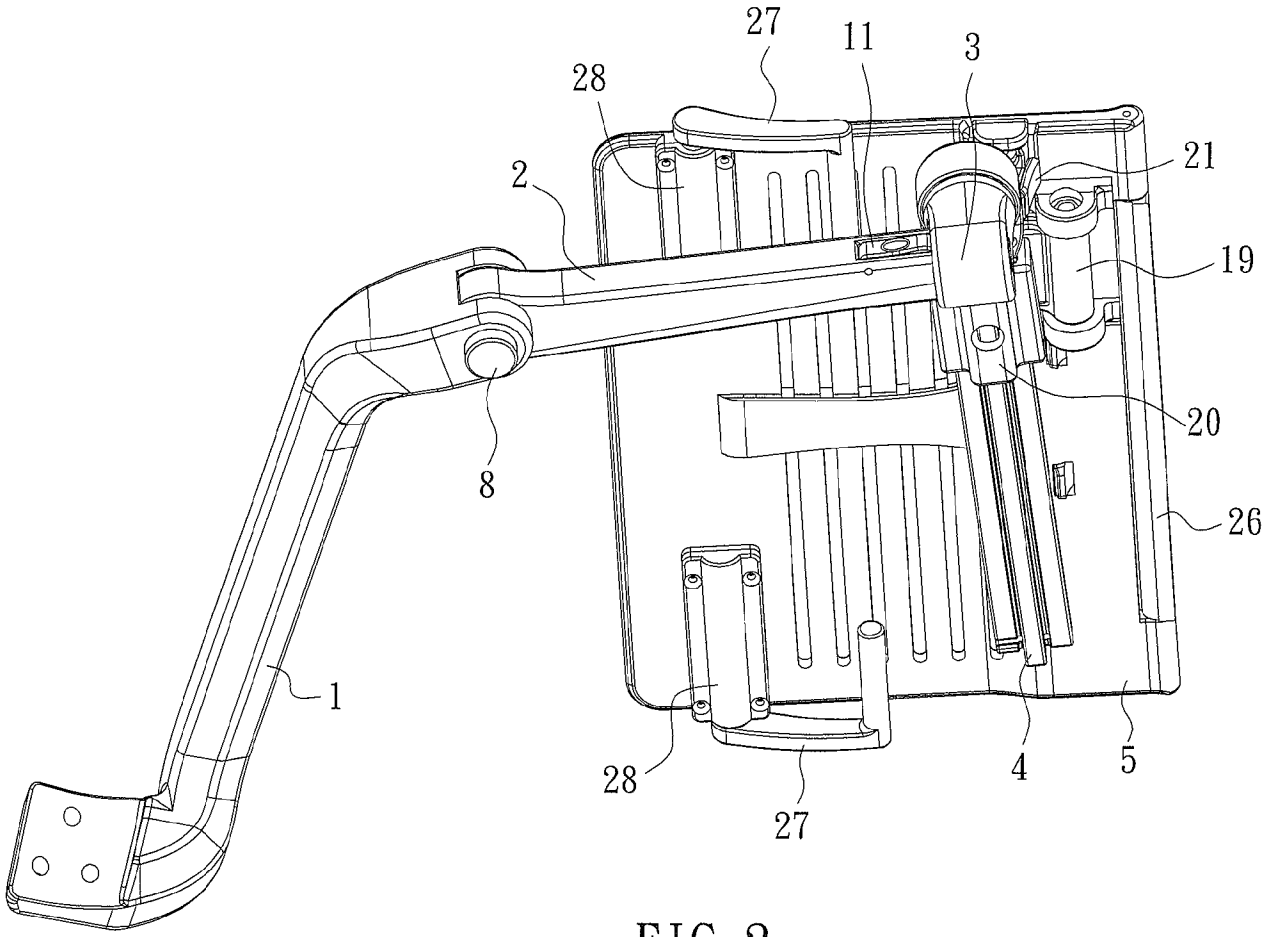
FIG. 2 is a perspective view showing the operation of the foldable bracket of the chair according to the present invention.

As shown in FIG. 2, the button 8 is pressed so that the four retaining bosses 61 of the first connecting element 6 are removed from the first hole 9, such that the first rotating rod 2 is rotated upward 90 degrees to release the button 8, and the four retaining bosses 61 are retained in the first hole 9 to position the first rotating rod 2.

Figure 3:
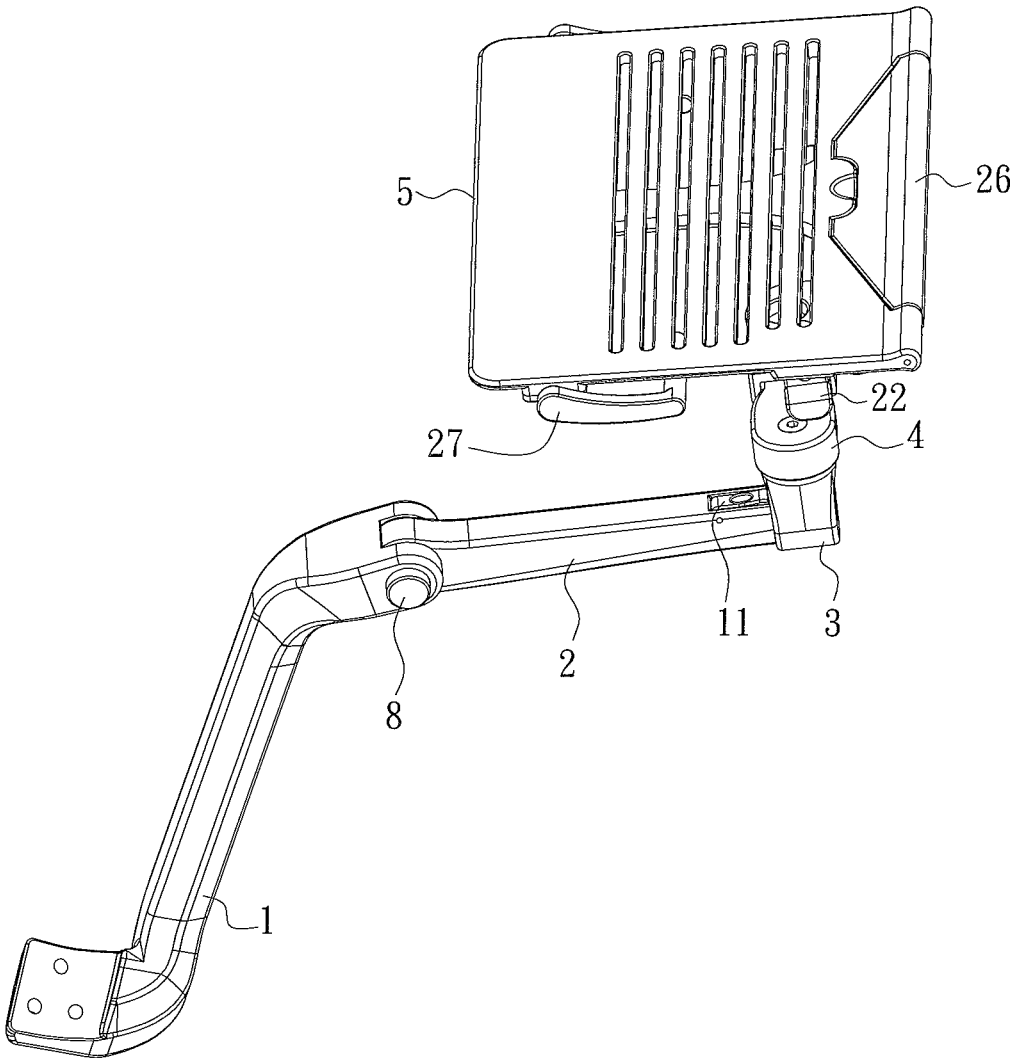
FIG. 3 is another perspective view showing the operation of the foldable bracket of the chair according to the present invention.

Referring to FIG. 3, the connector 3 is rotated upward 90 degrees to be fixed, and the second spring 12 is pushed against the locking projection 11 upward so that the locking projection 11 is retained in the second hole 13.

Figure 4:
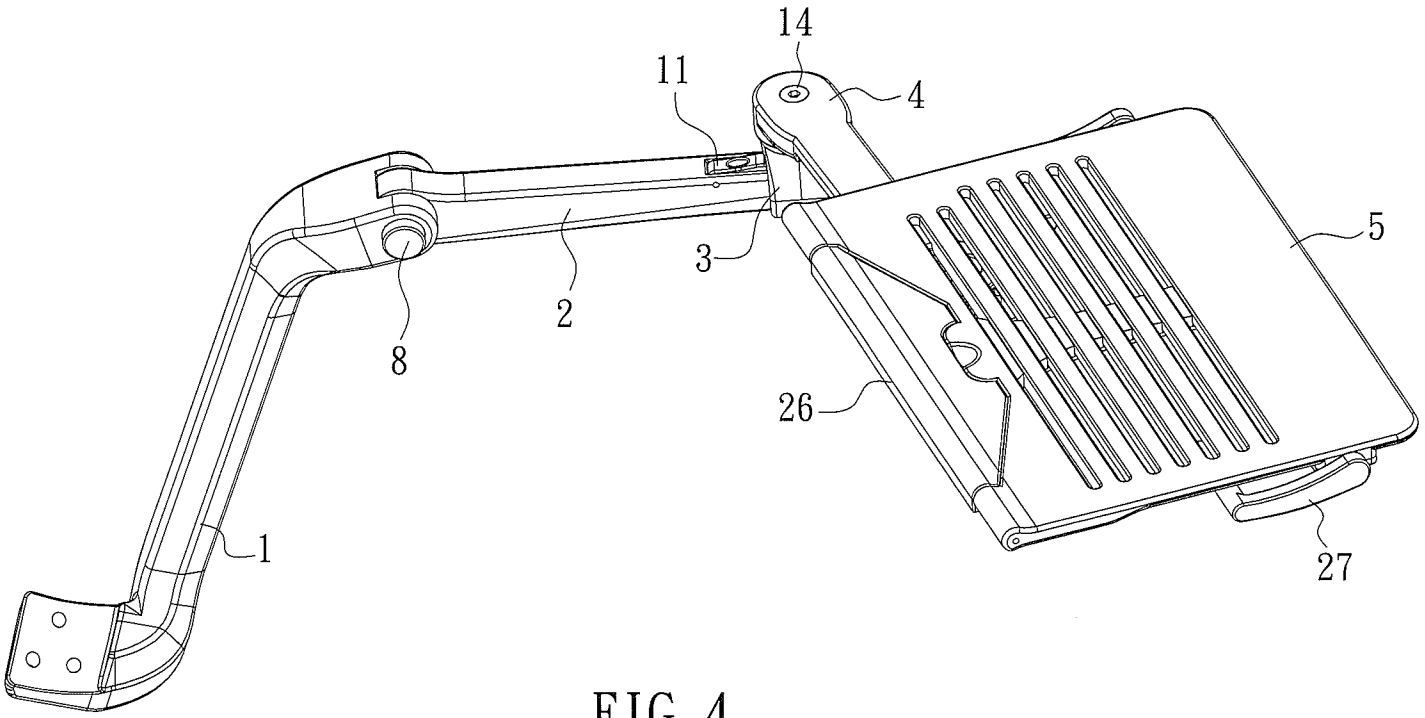
FIG. 4 is another perspective view showing the operation of the foldable bracket of the chair according to the present invention.

As illustrated in FIG. 4, the second rotating rod 4 is rotated horizontally toward a desired angle, and the third spring 16 pushes against the protrusion 15 so that the protrusion 15 abuts against the toothed portion 18 of the connector 3 to position the second rotating rod 4. Thereafter, the supporting plate 5 is pulled along the second rotating rod 4.

Figure 5:
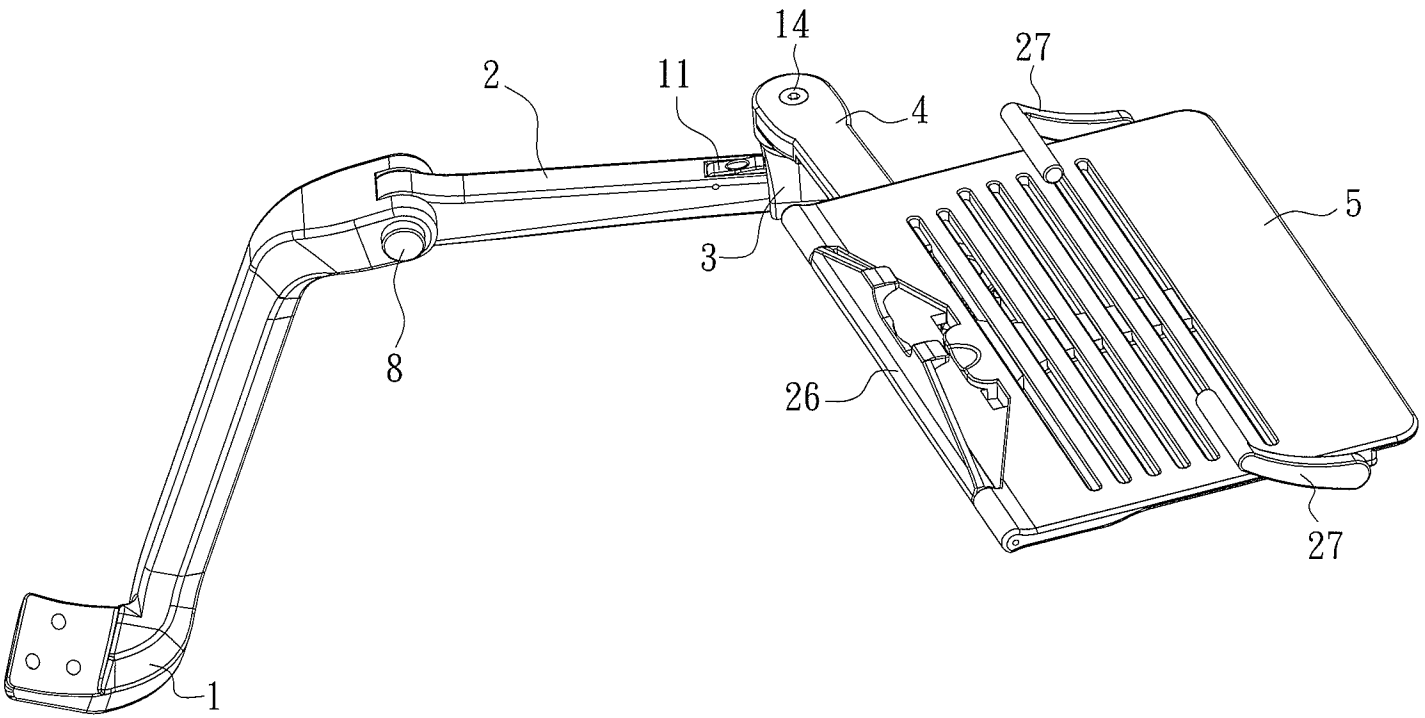
FIG. 5 is a perspective view showing the application of the foldable bracket of the chair according to the present invention.

With reference to FIG. 5, the inserting peg 25 is inserted into one of the three apertures 211, and the pedestal 22 is pressed so that the tabs 23 push the inserting peg 5, and the supporting plate 25 is turned upward to be adjusted toward a desired position. Thereafter, the stopping member 26 is rotated upward to place the book or the note book, and, then, the pressing members 27 are turned upward to press the book or to stop the note book.

If desiring to store the foldable bracket, the operating method is opposite to above-mention steps. Before the connector 3 is rotated, the locking projection 11 has to be pressed in advance.

Thereby, the foldable bracket of the present invention has the following advantages:

1. The foldable bracket includes the second rotating rod 4 to adjust a distance from a user's body and a positioning angle of the supporting plate 5 to satisfy a user's requirement.

2. The foldable bracket is capable of being folded to save use space and to enhance aesthetics appearance of the chair.

While various embodiments in accordance with the present invention have been shown and described, it is clear to those skilled in the art that further embodiments may be made without departing from the scope of the present invention.

What is claimed is:

1. A foldable bracket of a chair comprising:

a positioning rod, a first rotating rod, a connector, a second rotating rod, and a supporting plate, wherein the positioning rod is adapted to be connected with the chair, wherein the first rotating rod is rotatably coupled with the positioning rod, wherein the connector is joined with the first rotating rod, wherein the second rotating rod is rotatably coupled with the connector, and wherein the supporting plate is connected to the second rotating rod, wherein the supporting plate is joined with a fixing seat with three apertures, wherein the fixing seat also includes a pedestal with three tabs fixed therein, wherein the supporting plate is coupled with a holder and the holder includes a biasing spring and an inserting peg, wherein the biasing spring pushes against the inserting peg, and wherein the inserting peg is inserted in one of the three apertures.

2. The foldable bracket of the chair as claimed in claim 1, wherein the positioning rod is adapted to be connected with a leg of the chair, and wherein a connecting method of the positioning rod and the chair is selected from thread connecting, screw connecting, rivet jointing, and welding.

3. The foldable bracket of the chair as claimed in claim 2, wherein two bottom ends of two sides of the supporting plate are coupled with a stopping member, wherein the two upper ends of the two sides of the supporting plate are joined with two pressing members respectively, wherein each pressing member is covered by a cover and includes a rubber boss secured therein.

4. The foldable bracket of the chair as claimed in claim 2, wherein a first connecting structure of the first rotating rod and the positioning rod comprises a first connecting element with four retaining bosses, a first spring, and a button, wherein the first spring is fitted on the first connecting element, wherein the button is fixed on one end of the first connecting element, and wherein the retaining bosses are retained in a first hole of the positioning rod.

5. The foldable bracket of the chair as claimed in claim 4, wherein a second connecting structure of the connector and the first rotating rod comprises a second connecting element with a locking projection and a second spring, wherein the locking projection presses the second spring, and wherein the locking projection is retained in a second hole of the connector.

6. The foldable bracket of the chair as claimed in claim 5, wherein a third connecting structure of the second rotating rod and the connector comprises a third connecting element, a protrusion with a third spring, and a lid, wherein the lid covers the protrusion and the third spring, wherein the third spring pushes against the protrusion, and wherein the protrusion abuts against a toothed portion of the connector.

7. The foldable bracket of the chair as claimed in claim 1, wherein a first connecting structure of the first rotating rod and the positioning rod comprises a first connecting element with four retaining bosses, a first spring, and a button, wherein the first spring is fitted on the first connecting element, wherein the button is fixed on one end of the first connecting element, and wherein the retaining bosses are retained in a first hole of the positioning rod.

8. The foldable bracket of the chair as claimed in claim 7, wherein a second connecting structure of the connector and the first rotating rod comprises a second connecting element with a locking projection and a second spring, wherein the locking projection presses the second spring, and wherein the locking projection is retained in a second hole of the connector.

9. The foldable bracket of the chair as claimed in claim 8, wherein a third connecting structure of the second rotating rod and the connector comprises a third connecting element with a protrusion, a third spring, and a lid, wherein the lid covers the protrusion and the third spring, wherein the third spring pushes against the protrusion, and wherein the protrusion abuts against a toothed portion of the connector.

10. The foldable bracket of the chair as claimed in claim 7, wherein two bottom ends of two sides of the supporting plate are coupled with a stopping member, wherein the two upper ends of the two sides of the supporting plate are joined with two pressing members respectively, wherein each pressing member is covered by a cover and includes a rubber boss secured therein.

11. The foldable bracket of the chair as claimed in claim 8, wherein two bottom ends of two sides of the supporting plate are coupled with a stopping member, wherein the two upper ends of the two sides of the supporting plate are joined with two pressing members respectively, wherein each pressing member is covered by a cover and includes a rubber boss secured therein.

12. The foldable bracket of the chair as claimed in claim 9, wherein two bottom ends of two sides of the supporting plate are coupled with a stopping member, wherein the two upper ends of the two sides of the supporting plate are joined with two pressing members respectively, wherein each pressing member is covered by a cover and includes a rubber boss secured therein.

13. The foldable bracket of the chair as claimed in claim 1, wherein two bottom ends of two sides of the supporting plate are coupled with a stopping member, wherein the two upper ends of the two sides of the supporting plate are joined with two pressing members respectively, wherein each pressing member is covered by a cover and includes a rubber boss secured therein.

14. The foldable bracket of the chair as claimed in claim 1, wherein the supporting plate is coupled with a holder, wherein the holder is connected with a sliding block, wherein a connecting method of the holder and the sliding block is selected from sticking, thread connecting, screw connecting, rivet jointing, and welding, and wherein the sliding block is fitted on the second rotating rod.

15. The foldable bracket of the chair as claimed in claim 14, wherein two bottom ends of two sides of the supporting plate are coupled with a stopping member, wherein the two upper ends of the two sides of the supporting plate are joined with two pressing members respectively, wherein each pressing member is covered by a cover and includes a rubber boss secured therein.

16. The foldable bracket of the chair as claimed in claim 14, wherein a first connecting structure of the first rotating rod and the positioning rod comprises a first connecting element with four retaining bosses, a first spring, and a button, wherein the first spring is fitted on the first connecting element, wherein the button is fixed on one end of the first connecting element, and wherein the retaining bosses are retained in a first hole of the positioning rod.

17. The foldable bracket of the chair as claimed in claim 16, wherein a second connecting structure of the connector and the first rotating rod comprises a second connecting element with a locking projection and a second spring, wherein the locking projection presses the second spring, and wherein the locking projection is retained in a second hole of the connector.

18. The foldable bracket of the chair as claimed in claim 17, wherein a third connecting structure of the second rotating rod and the connector comprises a third connecting element with a protrusion, a third spring, and a lid, wherein the lid covers the protrusion and the third spring, wherein the third spring pushes against the protrusion, and wherein the protrusion abuts against a toothed portion of the connector.

* * * * *